US005973943A

United States Patent [19]

Ribarich et al.

[11] Patent Number: 5,973,943

[45] Date of Patent: Oct. 26, 1999

[54] NON ZERO-VOLTAGE SWITCHING PROTECTION CIRCUIT

[75] Inventors: Thomas J. Ribarich, Laguna Beach; Talbott M. Houk, Culver City, both of Calif.

[73] Assignee: International Rectifier Corporation, El Segundo, Calif.

[21] Appl. No.: 09/122,699

[22] Filed: Jul. 27, 1998

Related U.S. Application Data

[60] Provisional application No. 60/070,495, Jan. 5, 1998.

[51] Int. Cl.[6] ..... H02H 7/122

[52] U.S. Cl. ..... 363/56; 363/58; 323/235

[58] Field of Search ..... 363/16, 17, 95, 363/97, 98, 131, 132, 124, 55, 56, 58; 323/235, 268, 276, 282, 283; 361/78, 86, 87, 92, 100, 115

[56] References Cited

U.S. PATENT DOCUMENTS 5,233,287 8/1993 Lenk ..... 323/268

5,371,667 12/1994 Nakao et al. ..... 363/124

5,764,466 6/1998 Mangtani et al. ..... 361/78

*Primary Examiner*—Robert E. Nappi

*Assistant Examiner*—Y. J. Han

*Attorney, Agent, or Firm*—Ostrolenk, Faber, Gerb & Soffen, LLP

[57] ABSTRACT

A protection circuit for preventing non zero-voltage switching of a lamp resonant output circuit driven by upper and lower half-bridge switches. The protection circuit includes a sense resistor disposed between the lower half bridge switch and ground for developing a voltage corresponding to the current flowing through the lower switch. A comparator compares the voltage developed across the sense resistor against a fixed reference voltage and generates an output indicative of a non zero-voltage switching condition when the voltage across the sense resistor exceeds the fixed reference voltage. A latch is connected to the output of the comparator and generates a latch output signal which disables the generation of drive signals to the upper and lower switches in the event of a non zero-voltage switch condition.

6 Claims, 4 Drawing Sheets

DC BUS
HALF-BRIDGE
R1
VCC VB
HIN HO
LIN VS
COM LO
HIGH - LOW SIDE DRIVER
106
102
104
VS
C2
C1
LAMP RESONANT OUTPUT STAGE
IL
L1
LAMP
C3
RCS
VRCS
112
Vth
114
Q S
R
116
118
DR1
DR2
RST
UV
NON ZVS DETECTION
100
DRIVER LOGIC
108
FREQ HIN
UN
R
COM
VOLTAGE CONTROLLED OSCILLATOR (VCO)
110
FREQ
VIN
R
COM
VIN

NON ZERO-VOLTAGE SWITCHING PROTECTION CIRCUIT

This application claims the benefit of U.S. Provisional Application Ser. No. 60/070,495, filed on Jan. 5, 1998.

BACKGROUND OF THE INVENTION

When driving a resonant load with a high and low side half-bridge driver circuit, it is necessary to fulfill zero-voltage switching. This ensures smooth AC currents and voltages and provides a continuous uninterrupted inductor current. Should non zero-voltage switching occur while driving a fluorescent lamp with a resonant output stage (FIG. 1), high current spikes appear in the half-bridge switches, which can exceed the maximum current ratings of the switches and/or the resulting power losses in the switches can cause the switches to thermally destruct.

Non zero-voltage switching can occur due to one or both lamp filaments breaking resulting in an open-circuit, or a normal running lamp but a decreasing DC bus voltage. In each case, the half-bridge output voltage, $V_S$ (FIG. 2), must commutate to zero volts before the lower switch turns on or must commutate to the DC bus voltage before the upper switch turns on. If no lamp is present, no inductor current flows to commutate the capacitance from $V_S$ to ground due to the switch and (if present) the snubber capacitor C1. The circuit of the present invention senses the resulting current spike and turns both half-bridge switches off if spike exceeds a predetermined value.

SUMMARY OF THE INVENTION

The protection circuit of the present invention senses the current spike indicative of a non zero voltage-switching condition via a sense resistor disposed between the lower half bridge switch and ground. The sense resistor develops a voltage across it which corresponds to the current flowing through the lower switch. A comparator compares the voltage developed across the sense resistor against a fixed reference voltage and generates an output indicative of a non zero-voltage switching condition when the voltage across the sense resistor exceeds the fixed reference voltage. A latch is connected to the output of the comparator and generates a latch output signal which disables the generation of drive signals to the upper and lower switches in the event of a non zero-voltage switch condition.

In a preferred embodiment of the invention, the drive signals to the upper and lower switches are generated by a driver integrated circuit and driver logic, and are switched on and off at a frequency given by a voltage controlled oscillator, and the latch output signal is applied to reset pins of the driver logic and the voltage controlled oscillator. The circuit remains disabled until being reset by a recycling of the supply voltage or until a faulty lamp is removed and a new lamp is re-inserted.

Other features and advantages of the present invention will become apparent from the following description of the invention which refers to the accompanying drawings.

DETAILED DESCRIPTION OF THE PREFERRED EMBODIMENT

Figure 1:
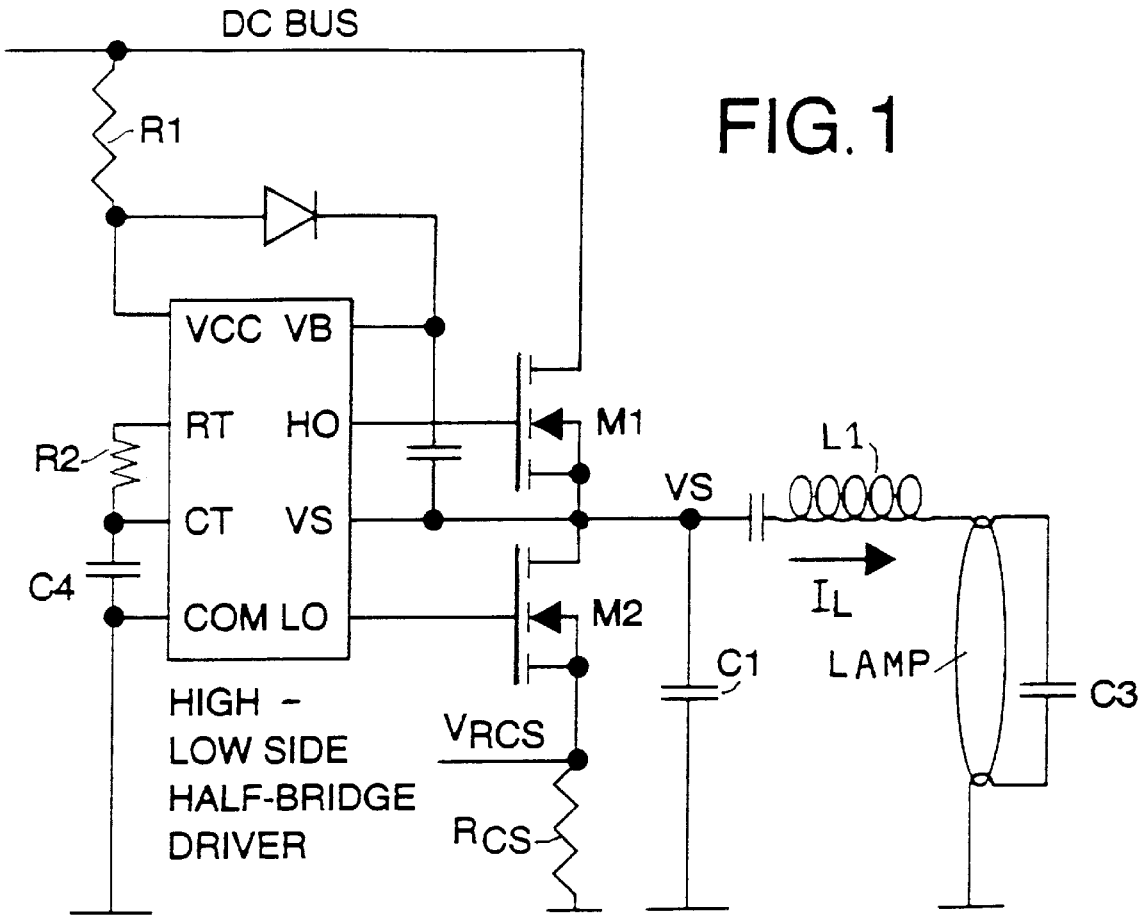
FIG. 1 shows a typical lamp resonant output circuit.
Figure 2:
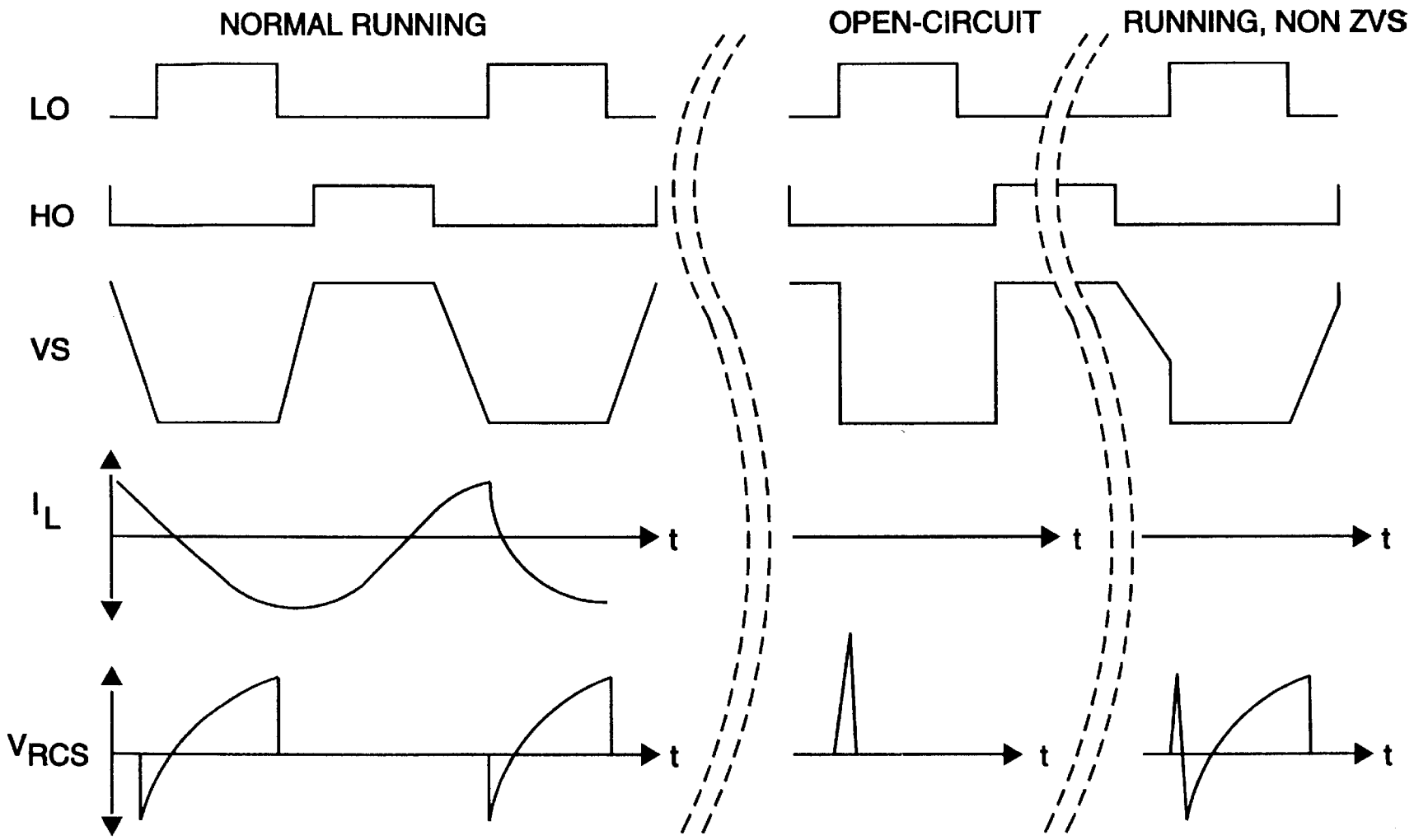
FIG. 2 shows the typical non zero-voltage switched waveforms for the lamp resonant output circuit of FIG. 1.
Figure 3:
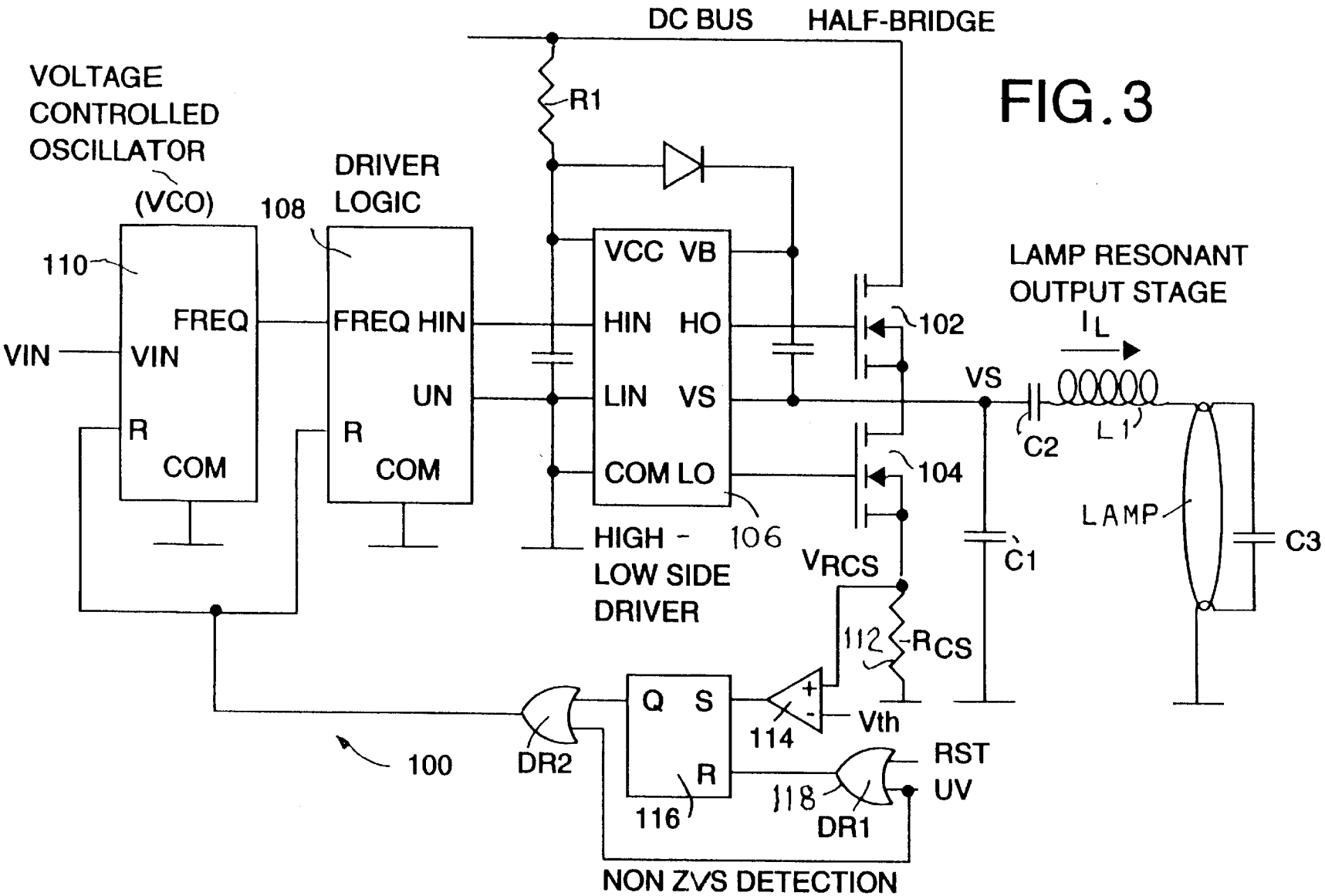
FIG. 3 shows the non zero-voltage switching detection circuit of the present invention.

Referring to FIG. 3, a lamp resonant output stage, identified generally by reference number 100, is driven by the half-bridge switches 102 and 104, which are preferably power MOSFETs or IGBTs. The half-bridge switches 102, 104 are controlled by a high/low side half-bridge driver IC 106 (such as the IR210X sold by International Rectifier Corporation) and driver logic 108, and are switched alternately on and off with a deadtime at a frequency given by the input voltage VIN of a voltage controlled oscillator (VCO) 110.

Figure 4:
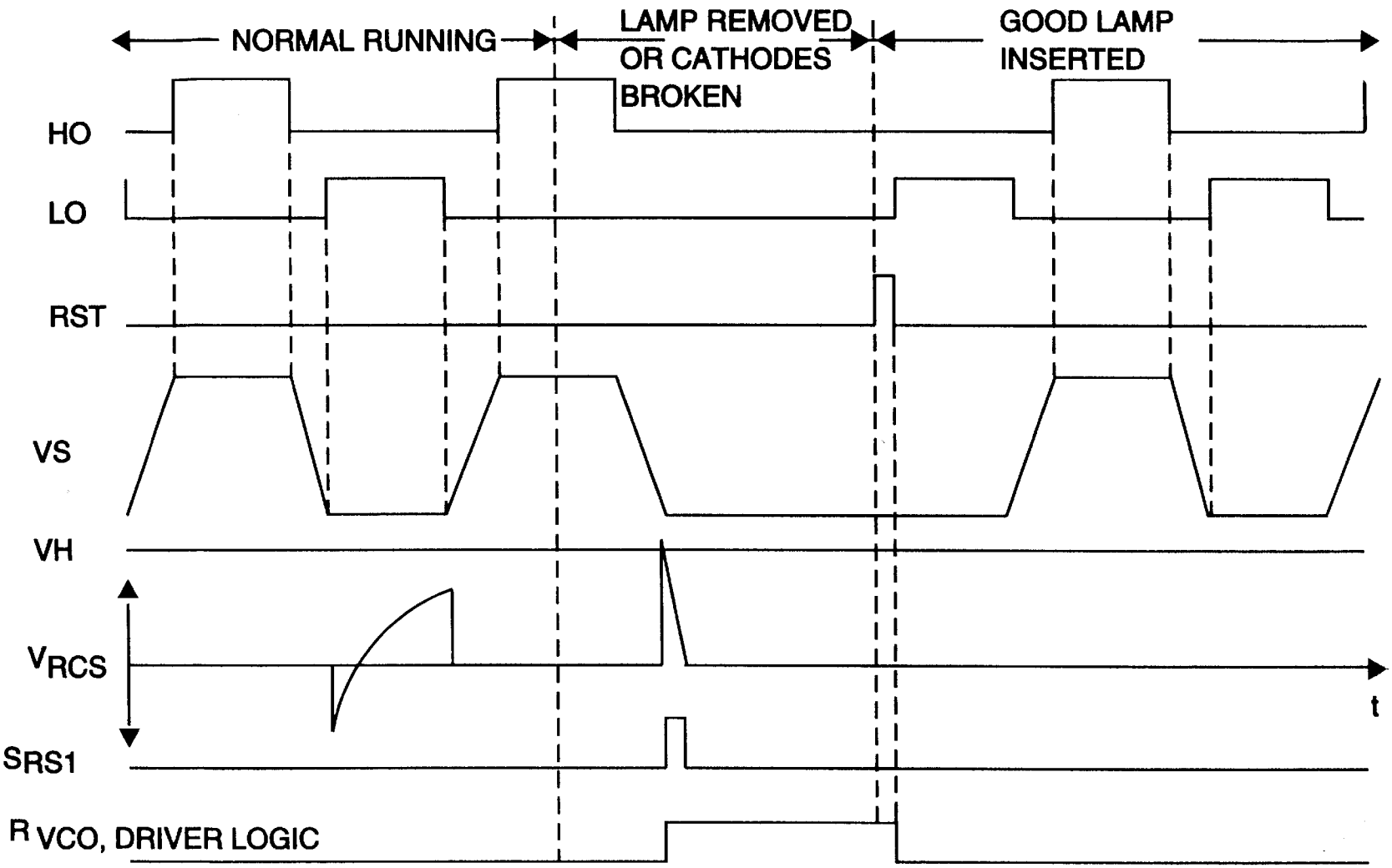
FIG. 4 is a waveform diagram for the non zero-voltage switching detection circuit of the present invention.

A sense resistor $R_{CS}$, identified by reference numeral 112, is disposed between the lower half-bridge switch 104 and ground to measure the current through lower switch 104. The resulting voltage $V_{RCS}$ is compared against a fixed threshold voltage $V_{th}$ with comparator 114. Should $V_{RCS}$ exceed $V_{th}$ in the event of non zero-voltage switching (non-ZVS), an RS-Latch 116 is set by the output of comparator 114 going "high", and therefore latching VCO 110 and Driver Logic 108 "off" through the reset (R) inputs. Switches 102 and 104 are then latched in tri-state mode (both off). As shown in the waveform diagram of FIG. 4, the circuit remains in this disabled mode until UV is cycled from a low to a high to a low again due to a recycling of circuit supply voltage VCC, or, the reset input to an OR gate 118 is cycled from a low to a high to a low due to a lamp removal and re-insertion.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A protection circuit for preventing non zero-voltage switching of a circuit comprising upper and lower switches disposed in a half-bridge arrangement, said protection circuit comprising:

a sense resistor disposed between the lower half bridge switch and ground for developing a voltage corresponding to the current flowing through the lower switch;

a comparator for comparing the voltage developed across the sense resistor against a non-zero fixed reference voltage and for generating an output indicative of a non zero-voltage switching condition when the voltage across the sense resistor exceeds the non-zero fixed reference voltage; and a latch connected to the output of the comparator for generating a latch output signal which disables the generation of drive signals to the upper and lower switches in the event of a non zero-voltage switch condition.

2. A protection circuit as recited in claim 1, wherein the drive signals to the upper and lower switches are generated by a driver integrated circuit and driver logic, and are switched on and off at a frequency given by a voltage controlled oscillator, and wherein the latch output signal is applied to reset pins of the driver logic and the voltage controlled oscillator.

3. A protection circuit as recited in claim 1, wherein the circuit remains disabled until being reset by a recycling of supply voltage or lamp removal and re-insertion.

4. A protection circuit for preventing non zero-voltage switching of a circuit comprising upper and lower switches disposed in a half-bridge arrangement, said protection circuit comprising:

a sense resistor disposed between the lower half bridge switch and ground for developing a voltage corresponding to the current flowing through the lower switch;

means for comparing the voltage developed across the sense resistor against a non-zero fixed reference voltage and for generating an output indicative of a non zero-voltage switching condition when the voltage across the sense resistor exceeds the non-zero fixed reference voltage; and means connected to the output of the means for comparing for generating an output signal which disables the generation of drive signals to the upper and lower switches in the event of a non zero-voltage switch condition.

5. A protection circuit as recited in claim 4, wherein the drive signals to the upper and lower switches are generated by a driver integrated circuit and driver logic, and are switched on and off at a frequency given by a voltage controlled oscillator, and wherein the latch output signal is applied to reset pins of the driver logic and the voltage controlled oscillator.

6. A protection circuit as recited in claim 4, wherein the circuit remains disabled until being reset by a recycling of supply voltage or lamp removal and re-insertion.

* * * * *